US006019936A

United States Patent [19]

Chung et al.

[11] Patent Number: 6,019,936

[45] Date of Patent: Feb. 1, 2000

[54] METHOD FOR MANUFACTURING FUNCTIONALLY GRADIENT COMPOSITE MATERIALS

[75] Inventors: Shyan-Lung Chung; Jiang-Ming Soon, both of Tainan, Taiwan

[73] Assignee: National Science Council, Taipei, Taiwan

[21] Appl. No.: 09/302,573

[22] Filed: Apr. 30, 1999

[30] Foreign Application Priority Data

Apr. 30, 1998 [TW] Taiwan ..... 87106737

[51] Int. Cl.[7] ..... B22F 7/00

[52] U.S. Cl. ..... 419/6; 419/47; 419/48; 428/547

[58] Field of Search ..... 419/6, 47, 48; 428/547

[56] References Cited

U.S. PATENT DOCUMENTS

| | | | |
|---|---|---|---|
| 5,340,533 | 8/1994 | Stangle et al. | 419/45 |
| 5,342,572 | 8/1994 | Stangle et al. | 419/45 |
| 5,794,113 | 8/1998 | Munir et al. | 419/45 |

OTHER PUBLICATIONS

Sata, "Fabrication of $TiB_2$–Cu Based Functionally Gradient Material by SHS Process." *Ceramic Engineering and Science Proceedings* 13 (7–8), pp. 384–391 (1992).

Wang et al., "Fabrication of $TiB_2$–Cu Composites and Functionally Gradient Materials by GPCS," *International Journal of Self–Propagating High–Temperature Synthesis* 3 (1), pp. 85–92 (1994).

Nidezialek and Stangle, "Combustion–Synthesized Functionally Gradient Refractory Materials," *Journal of Materials Research* 8(8), pp. 2026–2034 (Aug. 1993).

Feng and Moore, "The Effect of Pressure on the Combustion Synthesis of a Functionally–Graded Material: $TiB_2$–$Al_2O_3$–A1 Ceramic–metal Composite System," *Journal of Materials Engineering and Performance* 2 (5), pp. 645–650 (Oct. 1993).

Feng and Moore, "The Design of an Affordable, One–Step Process for the Production of a Functionally Graded Material (FGM)," *Journal of Materials Synthesis and Processing* 2 (6), pp. 367–377 (1994).

Yoshinari et al., "Development of Symmetric Gradient Structures for Hyperfunctional Materials by SHS/HIP Compaction," *Adv. Sci. Technol.* 10 (Intelligent Materials and Systems), pp. 87–98 (1995). (Abstract only).

Kang et al., "Fabrication and Characterization of $MoSi_2$/$A1_2O_3$/Ni/$A1_2O_3$/$MoSi_2$ FGms," *Zairyo* 44(501), pp. 705–709 (1995). Abstract only.

Yuji et al., "Preparation of (Molybdenum Disilicide–Silicon Carbide)/Titanium–Aluminum Functionally Gradient Materials by Gas–Pressure Combustion Sintering," *Funtai Oyobi Funmatsu Yakin* 37 (7), pp. 937–941 (1990). abstract only.

*Primary Examiner*—Ngoclan Mai
*Attorney, Agent, or Firm*—Chapman and Cutler

[57] ABSTRACT

A method for manufacturing a dense and functionally gradient composite material is provided. The method includes steps of preparing a reactant compact made of composite materials, igniting the reactant compact so that a combustion wave is propagating on the reactant compact, and compressing the reactant compact while the temperature profile of the reactant compact is gradient to obtain the dense and functionally gradient composite material.

26 Claims, 11 Drawing Sheets

Micro-hardness Value
=613.4 kgf/mm$^2$

Micro-hardness Value
=567.6 kgf/mm$^2$

Micro-hardness Value
=459.0 kgf/mm$^2$

Micro-hardness Value=443.7 kgf/mm$^2$

Micro-hardness Value=328.6 kgf/mm$^2$

METHOD FOR MANUFACTURING FUNCTIONALLY GRADIENT COMPOSITE MATERIALS

FIELD OF THE INVENTION

The present invention relates to a method for manufacturing composite materials, and more particularly to a method for manufacturing dense and functionally gradient composite materials.

BACKGROUND OF THE INVENTION

The conventional metal materials have good toughness and strength at low temperatures. However, at high temperatures, these materials have low strength and corrosion-resistance. The intermetallic materials have properties between those of metallic and ceramic materials. The intermetallic materials have lighter high-temperature strength than metal, and are not easily cracked as ceramics. Components in certain applications such as aerospace engines and gas turbines are normally operated at high-temperature surroundings. One end (or one side) of each of these components must have intermetallic characteristics such as the good strength at high temperatures and oxidation-resistance. The other end (or the other side) has metallic properties, i.e., it is tough and ductile at low temperatures. For example, components for constructing the starting motor of a national aerospace plane must be light and good in mechanical strength. Furthermore, the combustion-contact portion of the component must be high-temperature-resistant, oxidation-resistant, and corrosion-resistant. The conventional materials cannot meet all the requirements. However, a functionally gradient material (FGM) can solve the above-mentioned problems. The functionally gradient material can be made through combustion synthesis. In combustion synthesis, the reactants are made into a compact and then the compact is combusted to form the product. Conventionally, the composition ratio of the reactants in the compact is gradient-distributed or the compact is formed by several layers with different values of composition ratio so that the composition ratio of the whole compact is stepwise distributed. Then, the compact is combusted and compressed to be dense. The procedure for preparing a compact with gradient-distributed (or stepwise distributed) composition is very complex. Besides, the gradient of the material properties is determined when the compact is prepared. That is, when different functionally gradient materials are needed, different compacts must be prepared. Accordingly, the manufacturing time and cost are increased.

It is then attempted by the present invention to solve the above-mentioned problems.

SUMMARY OF THE INVENTION

An object of the present invention is to shorten the manufacturing time of a functionally gradient composite material.

The other object of the present invention is to provide a method for manufacturing a functionally gradient composite material with reduced cost.

The present invention provides a method for manufacturing dense and functionally gradient composite materials. Two kinds of powders such as Ti and Al powders are used as the reactants. These two powders are thoroughly mixed at an appropriate ratio and then pressed into reactant compacts with desired shapes. The reactant compact and a heating element are placed in a mold filled with casting sand or other fluidized medium. The combustion synthesis reaction is ignited by the heating element. A mechanical pressure is applied to the mold during propagation of the combustion wave. Densification of the product is achieved by the pressure transmitted through the casting sand. Furthermore, during the densification process, the heat loss of the compact is increased to cause the propagation of the combustion wave to be ceased. Accordingly, a gradient distribution of the conversion of the compounds is formed along the propagating direction of the combustion wave. Dense and functionally gradient composite material are therefore produced.

The present invention may best be understood through the following description with reference to the accompanying drawings, in which:

The present invention can be better understood by the following embodiments and accompanying drawings:

DETAILED DESCRIPTION OF THE PREFERRED EMBODIMENTS

Figure 1:
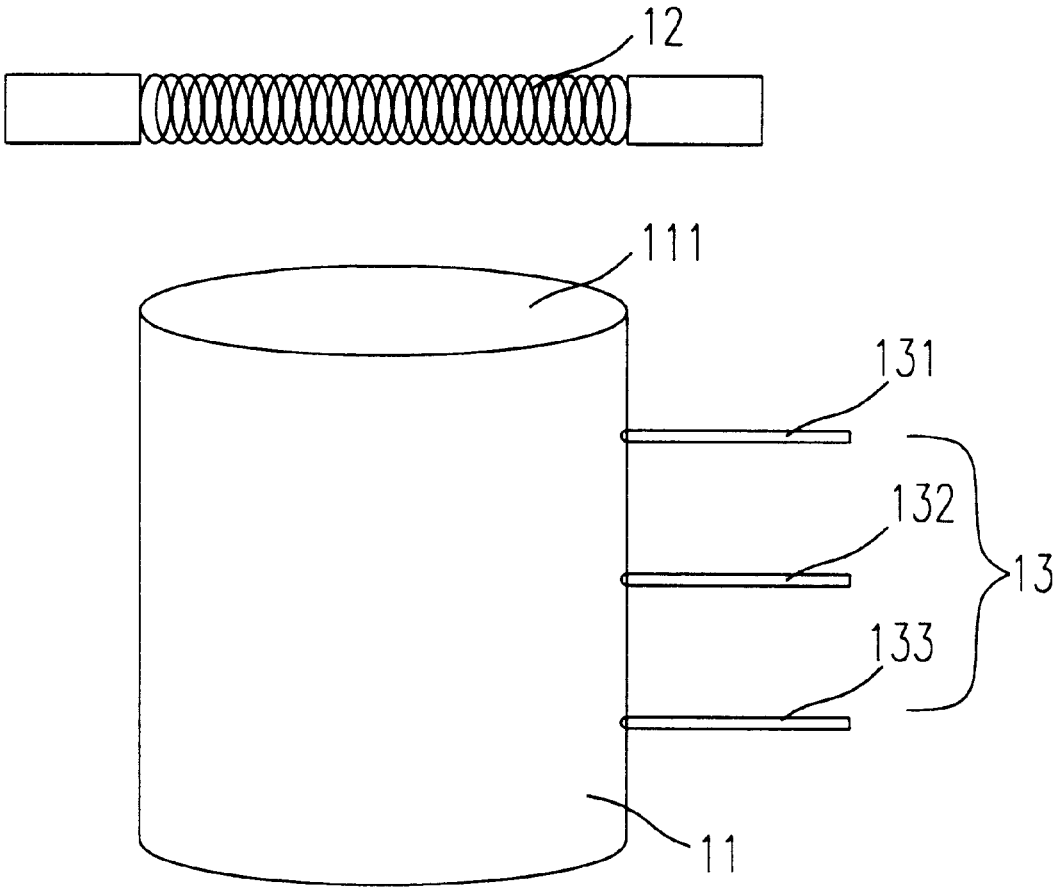
FIG. 1 is a diagram illustrating an embodiment of an apparatus for detecting the temperature distribution of a reactant compact according to the present invention.

The present invention provides a process for manufacturing dense and functionally gradient $TiAl_x$—Ti—Al composite materials. The process includes the steps as follows:

(1) Preparing a Titanium Powder and an Aluminum Powder, and Mixing Them Together to Form the React Compact The titanium powder and the aluminum powder are fully mixed in a desired ratio. The mixed powder is put into a mold to be compressed as a reactant compact with an appropriate shape. FIG. 1 illustrates a cylindrical reactant compact 11 formed by the compressed titanium/aluminum powder. The titanium powder and the aluminum powder are distributed evenly within the compact 11.

Figure 2:
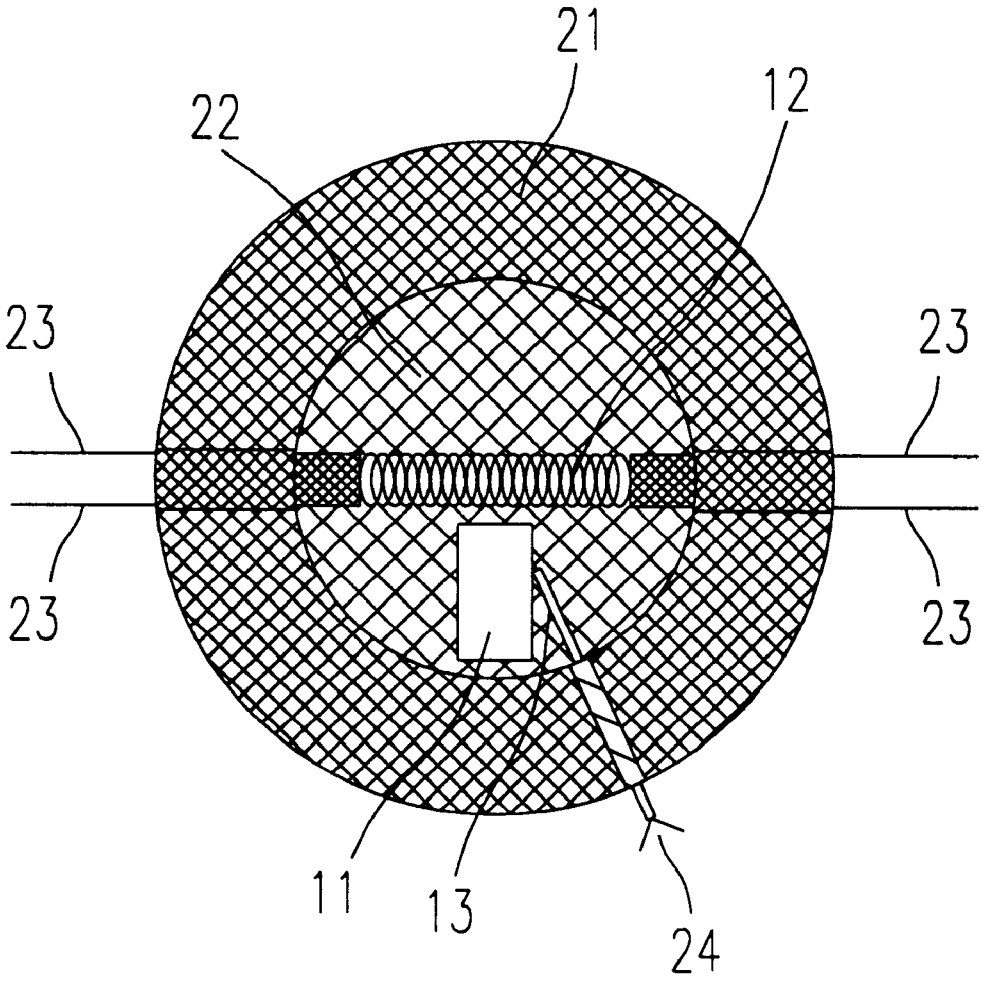
FIG. 2 illustrates a preferred embodiment of a heating and densifying apparatus according to the present invention.

(2) Putting the Reactant Compact and the Heating Element into a Mold Filled with a Fluidized Medium As shown in FIG. 2, the compact 11 and the heating element 12 (such as a tungsten filament, a tungsten slice, or a graphite slice, etc.) are placed into an alloy steel mold 21 fully filled with a fluidized medium 22. The fluidized medium can be a refractory material such as the casting sand or other ceramic powder. The mold 21 is then put into a hydraulic press or other pressurizing machine (such as the densifying apparatus shown in FIG. 5).

(3) Applying a Mechanical Pressure to the Mold When a Combustion Wave Is Propagating on the Compact One end 111 of the compact 11 is heated by the heating element 12 as shown in FIG. 1. The compact 11 is then ignited. The combustion of the compact forms a combustion wave transmitted from the end 111 to the other end of the reactant compact 11. During the propagation of the combustion wave, the temperature profile of the reactant compact 11 will be gradient along the combustion wave direction. When the temperature profile of the reactant compact 11 is gradient, a mechanical pressure is applied to the mold 21. By means of the casting sand 22, the applied pressure is transmitted to the whole compact 11. Accordingly, a dense and functionally gradient $TiAl_x$—Ti—Al composite material is then produced.

When compressing the mold 21, the pressure is transmitted around the compact 11 evenly by the fluidized casting sand 22 to compress the compact 11 to be dense. Furthermore, the casting sand 22 will be denser after compression, which will bring about a better heat conduction. Accordingly, the heat loss of the compact 11 is accelerated and then terminates the propagation of the combustion wave. The conversion of the titanium/aluminum intermetallic compound is directly proportional to the reaction time. When the pressure is applied, the temperature of the reactant compact 11 is diminished gradually from the combusted end to the other end of the compact 11. As the temperature is decreased along the propagating direction of the combustion wave, the reaction time of the reactants is also decreased along the same direction. Accordingly, the titanium/aluminum intermetallic compound in the combusted end has an utmost value of conversion, and the value of the conversion is lowered gradually alone the propagating direction of the combustion wave. It is deserved to be mentioned that the generative reaction for the $TiAl_x$ compound begins before the arrival of the combustion wave. At the moment that the combustion wave reaches, the reaction rate gets up to a maximum value. Even when the combustion wave has passed, the reaction still proceeds although a very high conversion has been achieved. So, the conversion ratio along the compact is distributed smoothly rather than stepwise.

Measuring the temperature of the compact can be useful to determine when to apply the pressure to the mold and how to control the pressure applying process. A preferred method for measuring the temperature is to use the thermocouple. Now, an example of using a thermocouple to measure the temperature for determining when to apply the pressure is described below.

Figure 3:
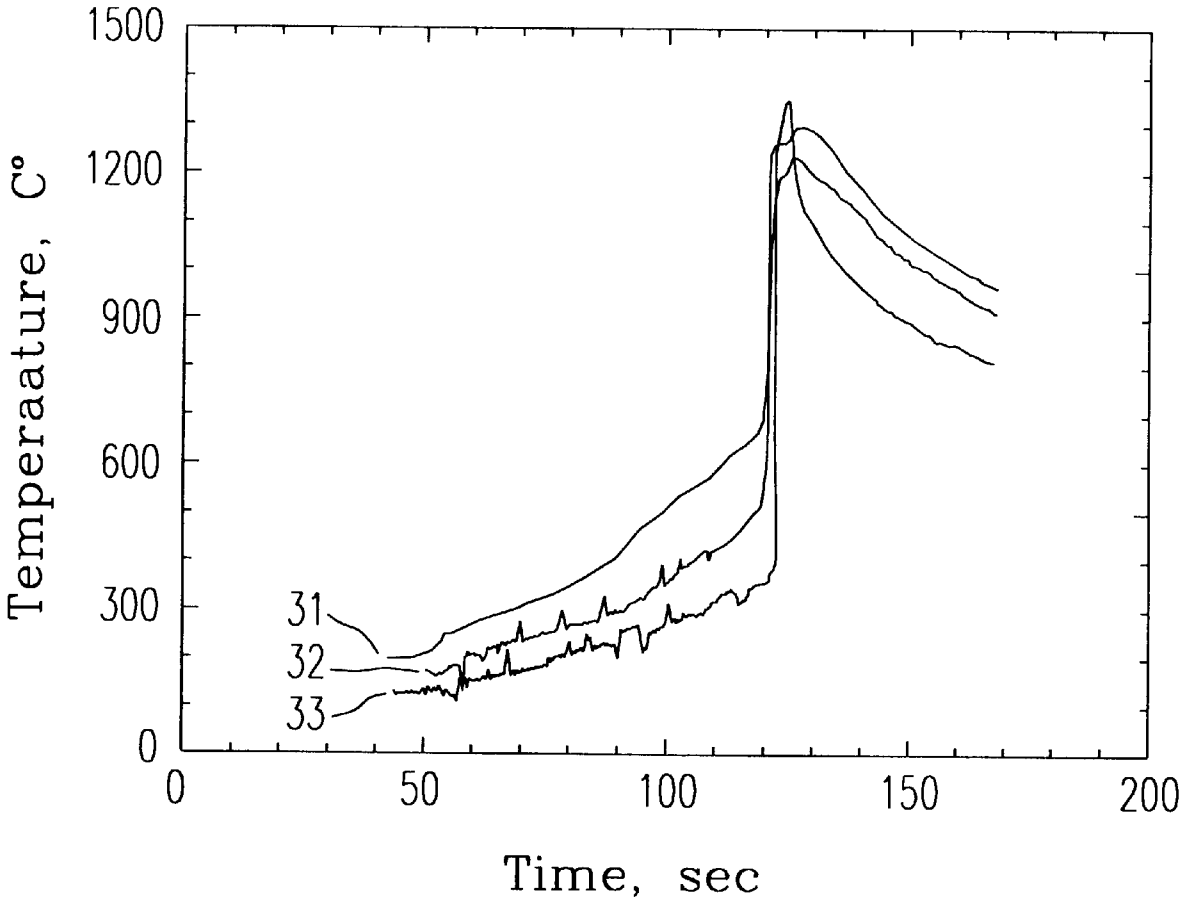
FIG. 3 is a temperature versus time diagram showing the detecting result of FIG. 1.
Figure 4:
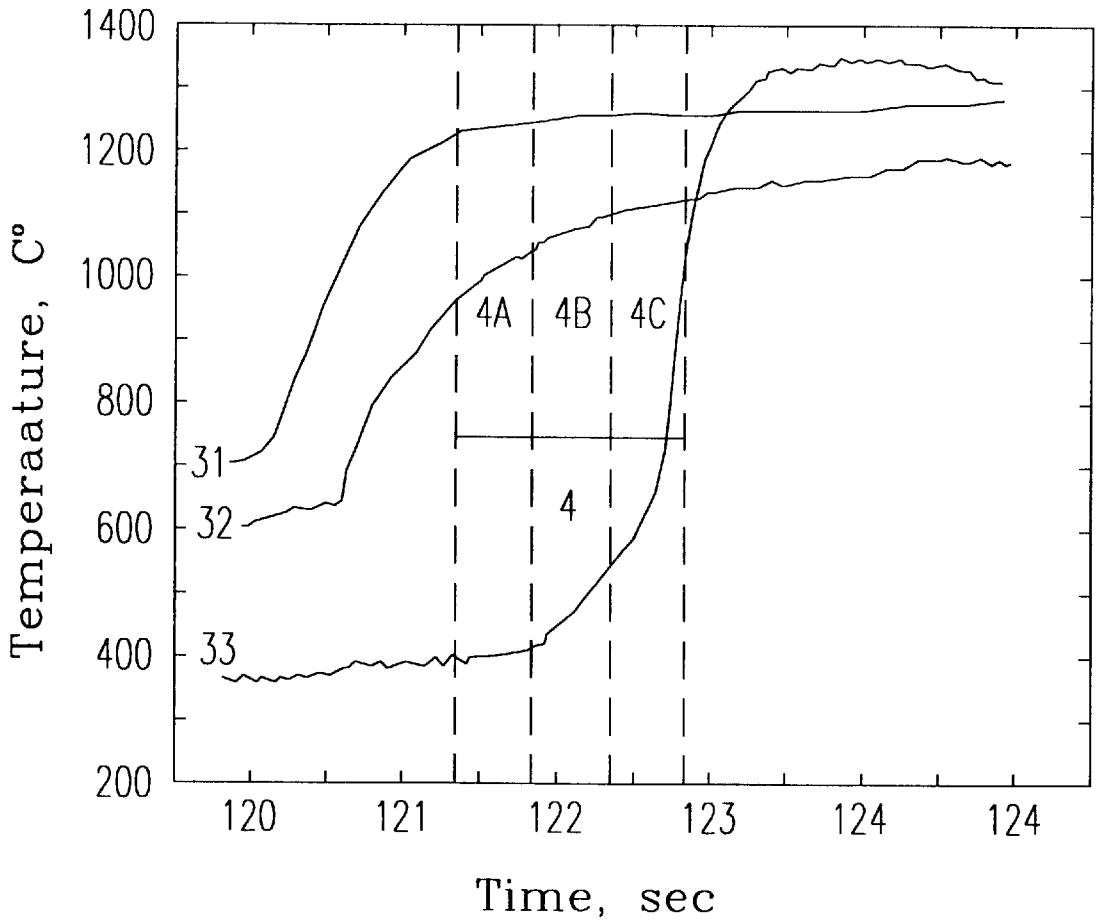
FIG. 4 is a partially enlarged diagram of FIG. 3 illustrating the rapidly elevated temperature portion.
Figure 9:
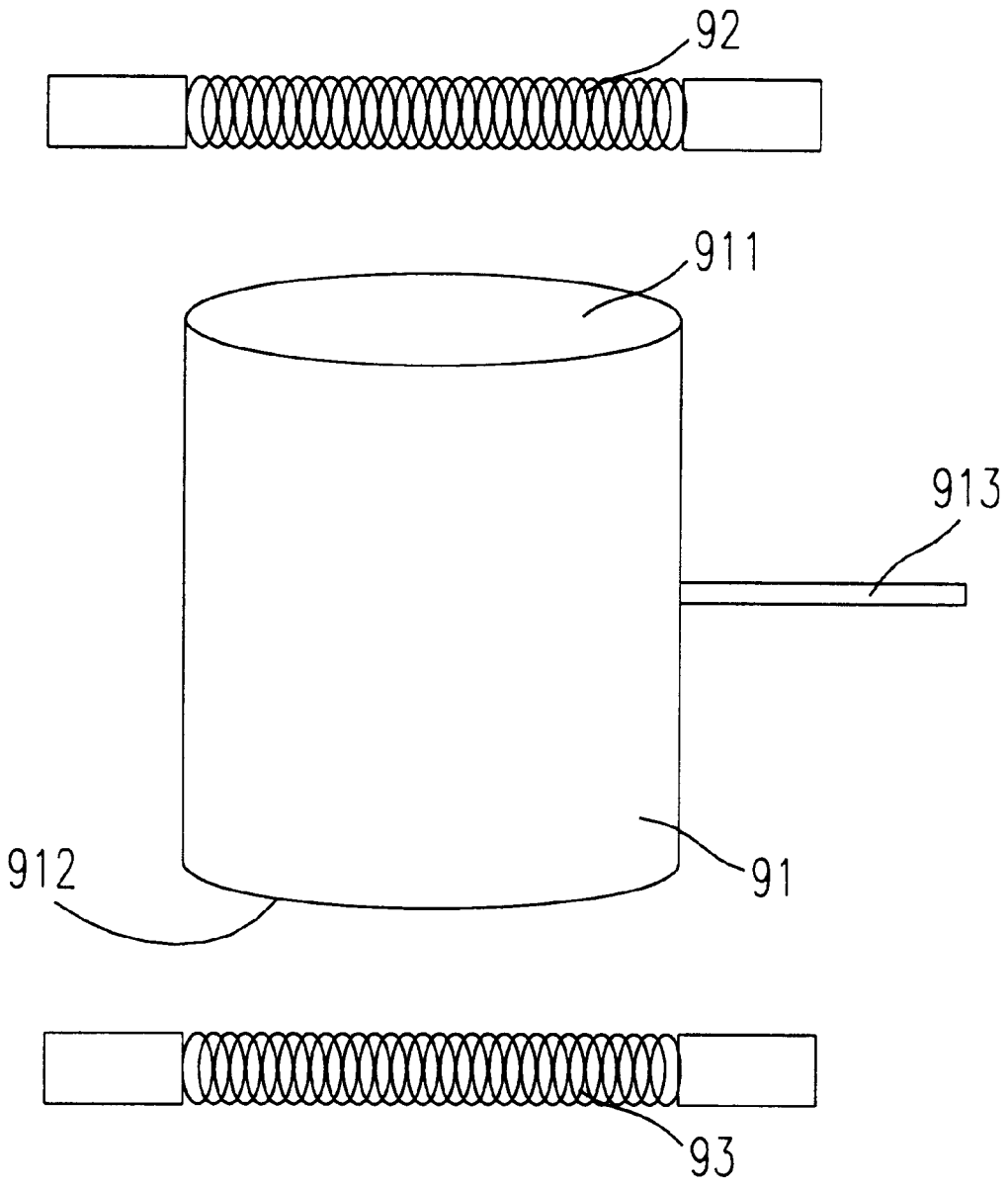
FIG. 9 illustrates the temperature-measuring device and the heating device of a compact of a preferred embodiment according to the present invention.

As shown in FIG. 1, a cylindrical reactant compact 11 has a diameter of 10 mm and a length of 12 mm. S-type thermocouples (Pt/Pt-10% Rh, 0.15 mm) 131, 132 and 133 contact with the reactant compact 11, and are 2.5 mm, 6 mm, 9.5 mm respectively away from the top end of the reactant compact 11. All the thermocouples are perpendicular to the longitudinal axis of the reactant compact 11 and the measuring points of these thermocouples contact the surface of the reactant compact 11 respectively. Firstly, a blank test is done. In the blank test, the compact 11 are burned in the casting sand 22 without applying pressure. The measuring results of the temperature measuring apparatus 13 indicate the temperature variance of the compact 11. The measuring results are indicated in FIG. 3. The curve 31, for example, indicates the variance of the temperature measured by the thermocouple 131 during the reaction. The heating element 12 begins to provide heat and it is observed that the temperature measured by the thermocouple 131 is raised smoothly. Because the top surface 111 of the reactant compact 11 is heated by the heating element 12 (such as a tungsten filament) evenly, the compact 11 is kindled on the whole top surface 111. Therefore, the combustion wave is sent through a whole cross section of the reactant compact 11. When the combustion wave is sent to the thermocouple 131, the temperature detected by the thermocouple 131 will raise rapidly. The temperature at which the temperature profile begins to raise rapidly is called an initial temperature. After the sudden raise, the temperature will reach a maximum value, which is called a burning temperature. Then, the temperature profile is descended smoothly. While the temperature detected by the thermocouple 131 raises rapidly, the temperatures detected by the thermocouple 132 and 133 respectively, i.e. the curves 32 and 33 of FIG. 3, will also be rapidly raised sequentially. Therefore, during the time when the temperatures measured by the three thermocouples raise rapidly, the temperature distribution of the reactant compact 11 from the top to the bottom is gradient. To observe this phenomenon more clearly, the time-scale of FIG. 3 is enlarged and the suddenly raised portions of the temperature curves 31, 32 and 33 are shown in FIG. 4. It is clear that there is a gradient temperature distributing duration 4. If a pressure is applied to the compact 11, a dense and functionally gradient material will be obtained. If the pressure is applied in the early duration 4A, each point of the compact 11 will have a low conversion of the $TiAl_x$ compound. Instead, if the pressure is applied in the middle duration 4B, the conversion will be higher. Of course, if the pressure is applied in the later duration, the conversion is even higher. By controlling the pressure-applied moment, not only is a functionally gradient material made, but also the conversion of $TiAl_x$ is controlled. Thus, the properties of the material is controlled. Furthermore, it is possible to obtain a symmetric product by modifying the heating method. As shown in FIG. 9, two heating elements 92 and 93 are respectively placed at the top end 911 and the bottom end 912 of the reactant compact 91. The ends 911 and 912 are heated by the heating elements 92 and 93 to be kindled simultaneously. Two combustion waves with opposite propagating directions will be sent respectively from their two ends to the opposite ends. While the two combustion waves are transmitted, the temperature profile of the reactant compact 91 will be gradient and symmetric to the center point of the compact 91. The pressure can be applied to the mold while such a symmetric temperature profile exists in the reactant compact 91. A functionally gradient material with symmetric structure will thus be obtained. Of course, if the pressure is applied while all the points in the reactant compact have reached the burning point, the product will be a dense and non-functionally-gradient material.

It is observed that the temperature profiles measured by the three thermocouples 131, 132 and 133 respectively have almost the same rapid-raised duration. Therefore, in a practical manufacturing process, only one thermocouple is needed. If the material to be manufactured is relatively long in length, a blank test (i.e. no pressure is applied) by several thermocouples is useful. The number and locations of these thermocouples can be adjusted as needed. After the execution of the blank test, one of these thermocouples can be chosen according to the rapid-raised portions of the temperature curves. The suitable time for applying the pressure can be determined according to the temperature curve of the chosen thermocouple. Furthermore, since the time periods of the rapid-raised portions of the temperature curves are quite reproducible, in a practical manufacturing process, a time recorder can be used to record the reaction time. The occasion for applying the pressure to the mold can be determined by the obtained record.

Figure 10:
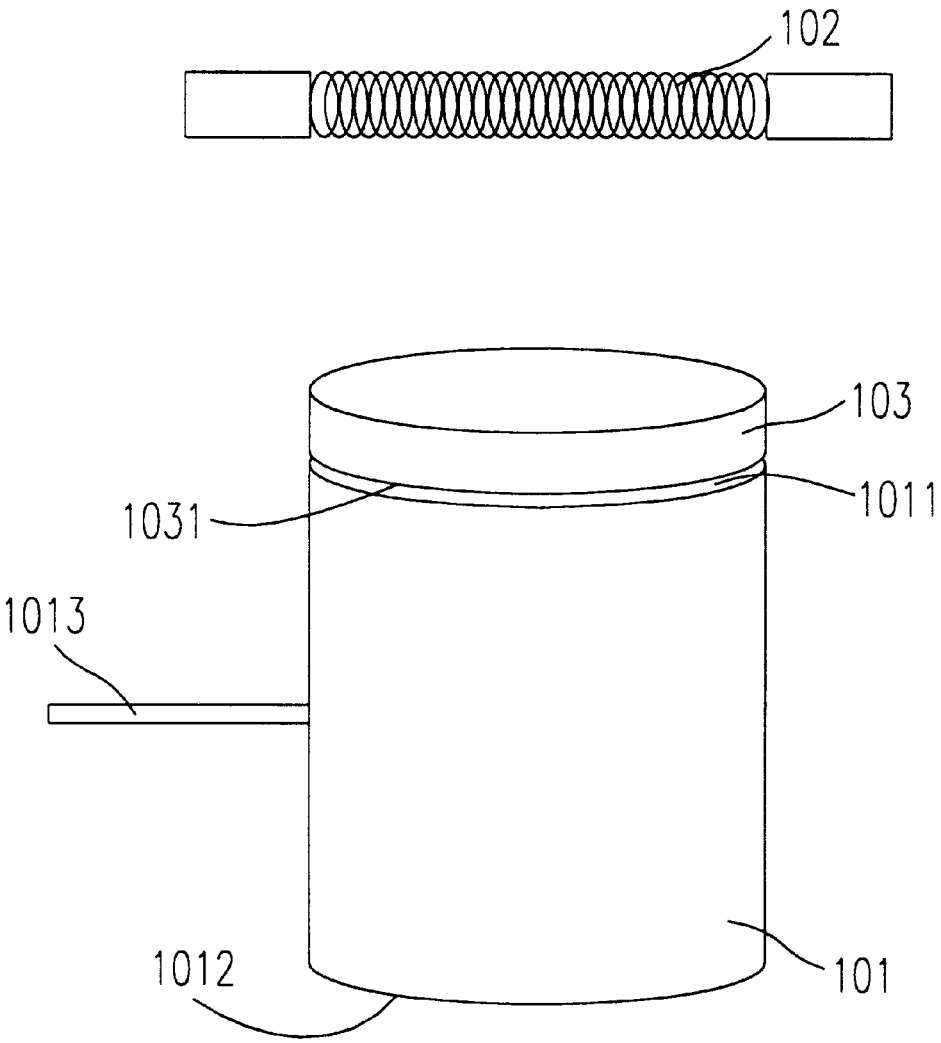
FIG. 10 illustrates a preferred embodiment of a compact with a kindling disk according to the present invention.

While reacting, the cross-section of the compact must have an uniform temperature so that each cross section may have a uniform composition and microstructure. If the cross section of the reactant compact is relatively large in area, a kindling medium can be used to make the cross section to be uniform in temperature. As shown in FIG. 10, the kindling medium can be a compact block 103 made of powders of highly combustible materials (such as Ti+C, $Mg+Fe_3O_4$, $Al+Fe_3O_4$, etc.). The mixed powders are compressed into the compact block 103 having a cross section 1031. The cross section 1031 has a shape and size the same as that of the heated cross section 1011 of the reactant compact 101. The compact block 103 is heated by the heating element 102 and then each point of the cross section 1031 burns simultaneously. The burning temperature of the compact block 103 will cause the whole points of the cross section 1011 to burn simultaneously. Accordingly, as the combustion wave propagates, every cross section of the compact 101 will have a uniform temperature and thus a uniform composition and microstructure are obtained.

Compared with the prior arts, the present invention has many differences and advantages. Some of them are as follows:

(1) In the past, a functionally gradient material must be made from a reactant compact having a gradient distribution of composition ratio or a reactant compact having several layers with different composition ratios. The preparation of the reactant compact is very complex. The reactant compact of the present invention is made from evenly mixed powders. It is seen that the efficiency of the process is enhanced and the cost is reduced.

(2) In prior arts, the pressure is applied after the combustion of the reactant compact has completed. In the present invention, the pressure is applied after the ignition of the reactant compact and before the termination of the reaction of the reactants.

(3) The prior arts never mention about controlling the distribution of composition by controlling the occasion of applying pressure to the reactant compact. The method of the present invention controls the pressure-applying occasion to obtain a desired functionally gradient material. The present invention also provides that the pressure-applying occasion is controlled according to the temperature measured from the reactant compact.

(4) In prior arts, the composition distribution of a functionally gradient product is determined according to the reactant composition. If there is a desired distribution, a specific reactant compact must be prepared. The composition distribution of the product of the present invention can not only be determined by the reactant compact composition, but also changed and controlled by controlling the pressure-applied occasion.

Except for the above-mentioned $TiAl_x$—Ti—Al composite materials, the method of the present invention can also be applied to the manufactures of many other dense and functionally gradient intermetallic-metallic composite materials. Examples of these materials are $NiAl_x$—Ni—Al, $FeAl_x$—Fe—Al, $TiNi_x$—Ti—Ni, and $TiFe_x$—Ti—Fe.

Figure 5:
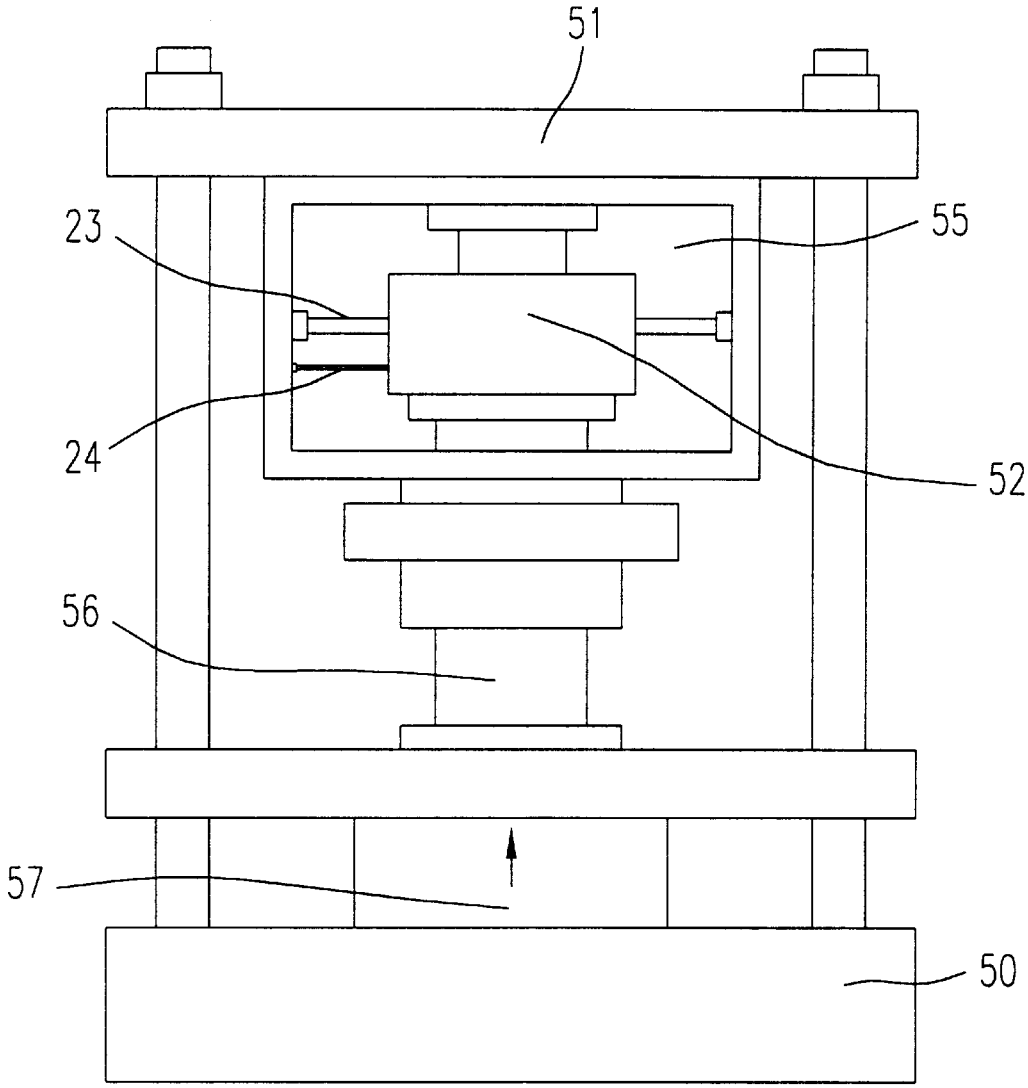
FIG. 5 illustrates a preferred embodiment of a densifying apparatus according to the present invention.

A preferred embodiment of the present invention is detailed described as below:

First of all, a titanium powder of −325 mesh and an aluminum powder of −325 mesh are prepared. The atomic ratio of the titanium to the aluminum is 1:1. Then, the two powders are sufficiently mixed by manual grinding or other mixing method. The mixed powders are then compressed in a mold by a mold-compressing device to form the reactant compact. The applied pressure is 30 kg/cm$^2$. The obtained reactant is a cylinder with 10 mm in diameter and 12 mm in length. Referring to FIG. 2, casting sand 22 is filled into an alloy steel mold 21. The alloy steel mold 21 is a cylinder with an inner diameter of 45 mm, an outer diameter of 125 mm, and a depth of 60 mm. The casting sand 22 is filled within the mold 21 from the bottom to an appropriate height. A tungsten filament 12 with 0.6 mm in diameter is wound into a coil having a diameter of 4.8 mm and is mounted in the mold 21. The electric wires 23 connected to the two ends of the tungsten filament 12 pierce through the mold 21. The reactant compact 11 is pushed into the casting sand 22. The longitudinal axis of the reactant compact 11 is parallel to the top surface of the casting sand. A thermocouple 24 pierces into the mold 21. The measure point of the thermocouple 24 contacts the axially middle point of the reactant compact 11. The casting sand 22 is then continuously filled into the mold 21 until the reactant compact 11, the heating element 12 and the thermocouple 24 are all buried by the casting sand 22. The upper push rod (not shown) of the mold 21 is then inserted and compressed tightly. The whole mold 21 is put into the reaction chamber 55 of a hydraulic press 50, as shown in FIG. 5. The electric wires 23 and the thermocouple 24 are connected to a power supply (not shown) and a temperature-reading apparatus (not shown) respectively. The power supply is switched on to provide a 50 Watt power to the heating element 12 for heating the end 111 of the reactant compact 11. When the temperature indicated on the temperature-reading device arrives the middle duration of the gradient temperature profile (which is similar to the middle duration of the temperature curve 32 shown in FIG. 4), the hydraulic press 50 is immediately started to apply a 324-MPa pressure to the mold 21. The compressing process is sustained for 5 minutes. After the compression, the mold 21 is taken out of the hydraulic press 50 and opened. The casting sand 22 is knocked into pieces to take out the product 11.

Figure 6:
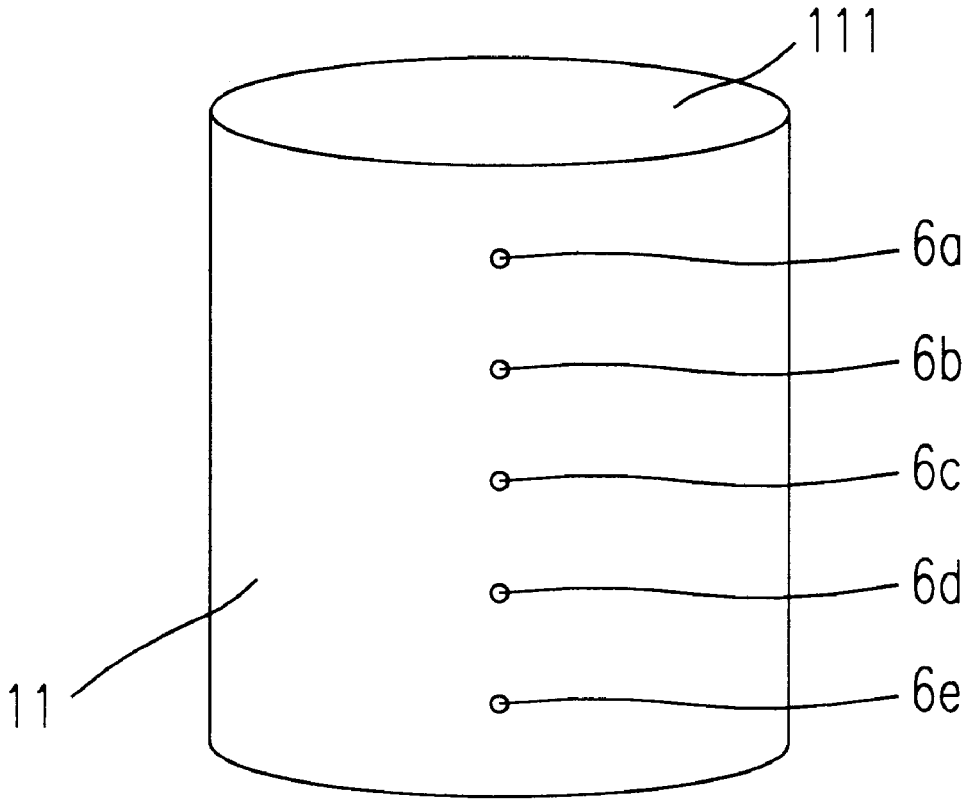
FIG. 6 indicates the locations of cross sections of a product of a preferred embodiment according to the present invention.
Figure 7:
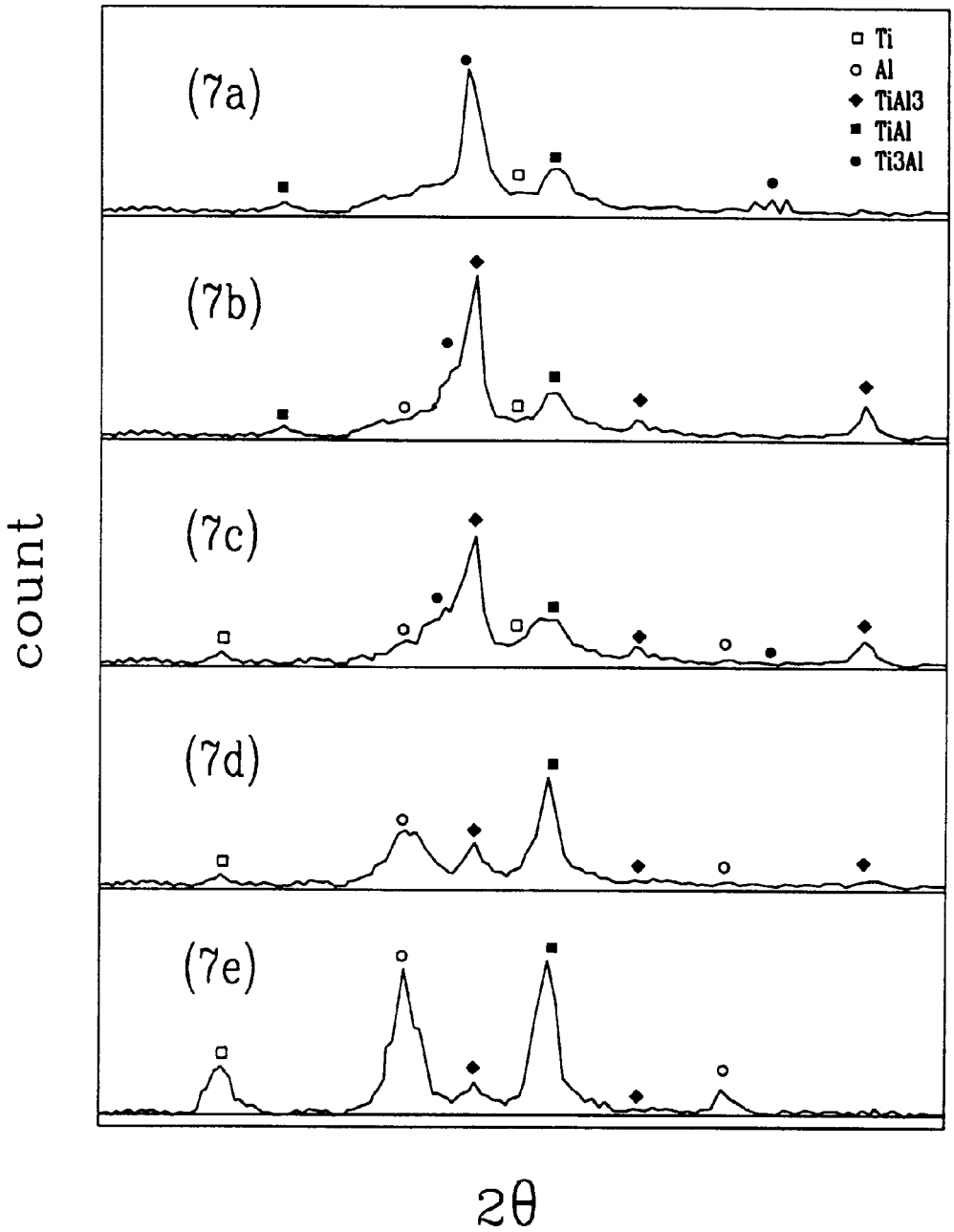
FIG. 7 illustrates XRD measuring results of the cross sections indicated in FIG. 6.
Figure 8A:
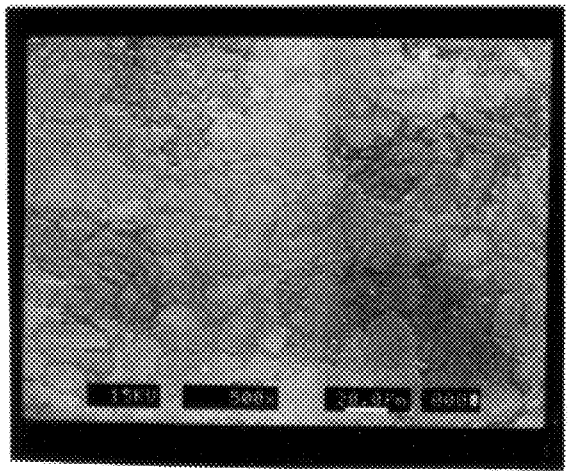
FIGS. 8(*a*)–8(*e*) are SEM (scanning electron microscope) photomicrographs of the cross sections indicated in FIG. 6.
Figure 8B:
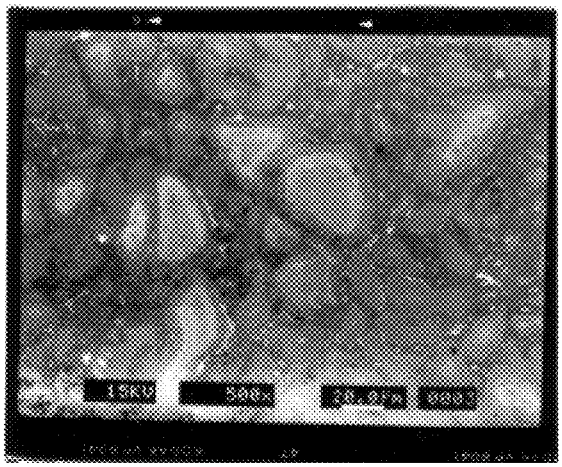
Figure 8C:
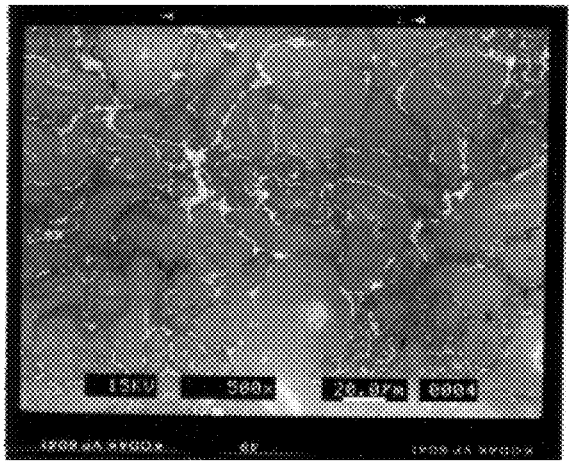
Figure 8D:
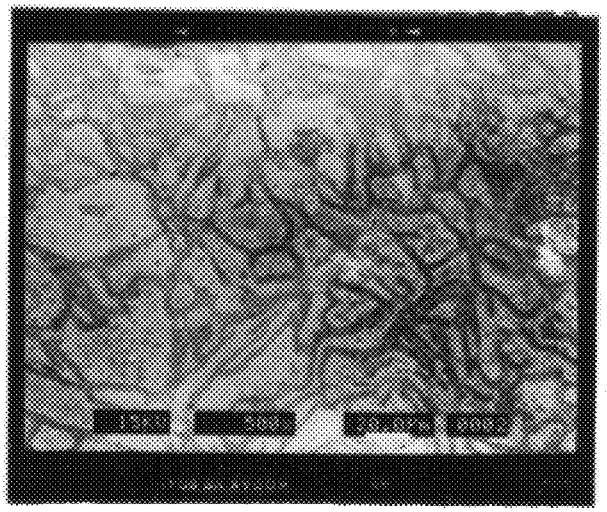
Figure 8E:
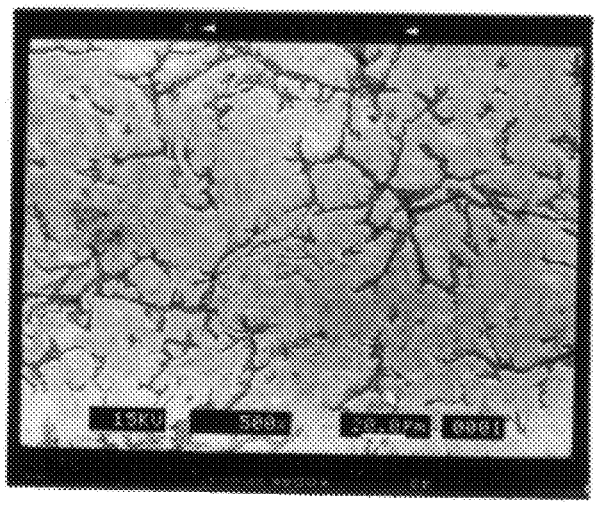

To understand the inner microstructure and the composition distribution of the product, the product 11 is cut into pieces along the cross section. The cut points are distributed every 2 mm from the top surface 111 along the longitude axis of the product 11, as the points 6*a*–6*e* indicated in FIG. 6. When one piece is cut, the cut surface is ground and polished. Then, the piece is analyzed by XRD, SEM, and a micro-hardness measurement. The result of the XRD analysis is shown in FIG. 7. It is observed that the piece which is nearest to the top surface 111, i.e. the slice 6*a*, has the largest amount of Ti—Al intermetallic compound and the fewest Ti and Al (see curve (7*a*)). The farther the slice away from the top surface 111, the fewer Ti—Al compound and the more Ti and Al. It is known that, from the top surface to the bottom surface of the product, the amount of Ti—Al compound is decreased while the amount of the Ti and Al are increased. The SEM microphotographs of the slices 6*a*–6*e* are shown in FIGS. 8(*a*)–8(*e*) respectively. By means of EDS, it is known that the brighter portions of the SEM photograph indicate the Ti component, while the darker portions represent the Al component, and the gray portions specify Ti—Al compound. From slices 6*a* to 6*e*, it is seen that the amount of the Ti—Al compound is decreased and the amounts of Ti and Al are increased. These photographs also indicate that the product has a pretty high denseness. The values of the measured micro-hardness of the slices 6*a*–6*e* are 613.4, 567.6, 459.0, 443.7 and 328.6 (kgf/mm$^2$) respectively. These values are also respectively indicated in FIGS. 8(*a*)–8(*e*). It is seen that the slice having the most Ti—Al compound (i.e. slice 6*a*) is hardest (613.4 Kgf/mm$^2$). The values of the hardness from the slice 6*a* to the slice 6*e* are decreased. The slice 6*e* has a smallest hardness (328.6 Kgf/mm$^2$). The product is functionally gradient in the mechanical property.

The present invention can be further understood by the following preferred embodiments. It is notable that these embodiments are not to limit the scope of the present invention but just explanatory descriptions.

Embodiments 1–6

Different Heating Powers and Heating Elements

A titanium powder of −325 mesh and an aluminum powder of −325 mesh are mixed. The atomic ratio of Ti:Al is 1:1. The mixed powder is compressed under a pressure of 30 kg/cm$^2$ to form a reactant compact having a diameter of 10 mm and a height of 12 mm. The reactant compact is put into the mold. The thermocouple 132 as shown in FIG. 1 is used to measure the temperature of the reactant compact. Various powers are applied to different heating elements in different embodiments respectively. One end of the reactant compact is then heated and ignited. When the temperature of the reactant compact reaches the middle duration of the gradient temperature profile, a 324 MPa is applied. Accordingly, the product is obtained. The product is analyzed by SEM, XRD, and micro-hardness measurement and is identified as to be a $TiAl_x$—Ti—Al functionally gradient composite material. The parameters of these embodiments are listed in Table 1.

TABLE 1

| embodiment | heating power (Watt) | Heating element |
|---|---|---|
| 1 | 100 | Tungsten filament |
| 2* | 200 | Tungsten filament |
| 3 | 300 | Tungsten filament |
| 4 | 50 | Tungsten slice |
| 5* | 50 | Graphite slice |
| 6 | 50 | graphite tape |

In Table 1, the fluidized medium in the embodiment labeled "*" is $Al_2O_3$ powder.

Embodiments 7–8

Different Mechanical Pressures

A titanium powder of −325 mesh and an aluminum powder of −325 mesh are mixed. The atomic ratio of Ti:Al is 1:1. The mixed powder is compressed under a pressure of 30 kg/cm$^2$ to form a reactant compact having a diameter of 10 mm and a height of 12 mm. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, the mechanical pressure is applied. Different mechanical pressures as shown in Table 2 are applied to the mold in different embodiments respectively. Accordingly, the product is obtained. The product is analyzed by SEM, XRD, and micro-hardness measurement and is identified as a $TiAl_x$—Ti—Al functionally gradient composite material. The parameters of these embodiments are listed in Table 2.

TABLE 2

| embodiment | mechanical pressure (MPa) |
|---|---|
| 7 | 200.6 |
| 8 | 462.9 |

Embodiments 9–11

Different Molding Pressures

A titanium powder of −325 mesh and an aluminum powder of −325 mesh are mixed. The atomic ratio of Ti:Al is 1:1. The mixed powder is compressed under different molding pressures (as shown in Table 3) in different embodiments respectively to form reactant compacts having a diameter of 10 mm and a height of 12 mm. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 3.

TABLE 3

| embodiment | Molding pressure (kg/cm2) |
|---|---|
| 9 | 20 |
| 10* | 60 |
| 11 | 80 |

In Table 3, the fluidized medium in the embodiment labeled "*" is $ZrO_2$ powder instead of casting sand.

Embodiments 12–14

Different Compact Sizes

A titanium powder of −325 mesh and an aluminum powder of −325 mesh are mixed. The atomic ratio of Ti:Al is 1:1. The mixed powder is compressed under a molding pressure of 30 kg/cm$^2$ to form a reactant compact. Reactant compacts with different sizes are formed in different embodiments respectively. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 4.

TABLE 4

| Embodiment | compact size (diameter × height)(mm) |
|---|---|
| 12 | 10 × 5 |
| 13 | 10 × 15 |
| 14* | 20 × 20 |

In Table 4, the embodiment which is labeled "*" indicates that a kindling block is used. The kindling block is made by compressing $Mg/Fe_3O_4$ mixed powder in a mold. The block is 20 mm in diameter and 2 mm in thickness.

Embodiments 15–17

Different Titanium/Aluminum Atomic Ratios

A titanium powder of −325 mesh and an aluminum powder of −325 mesh are mixed. The atomic ratios of Ti/Al are different in different embodiments (As shown in Table 5). The mixed powder is compressed tinder a molding pressure of 324 MPa to form a reactant compact having a diameter of 10 mm and a height of 12 mm. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 5.

TABLE 5

| Embodiment | Atomic ratio (Ti:Al) |
|---|---|
| 15 | 1:0.923 |
| 16* | 1:2 |
| 17 | 1:3 |

In Table 5, SiC powder, instead of casting sand, is used as a fluidized medium in the embodiment labled "*".

Embodiments 18–21

Different Particle Sizes of Titanium Powder and Aluminum Powder

As shown in Table 6, titanium powders and aluminum powders with different particle sizes are mixed in different embodiments respectively. The atomic ratio of Ti:Al is 1:1. The mixed powder is compressed under a molding pressure of 30 kg/cm$^2$ to form a reactant compact having a diameter of 10 mm and a height of 12 mm. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 6.

TABLE 6

| embodiment | Ti particle (mesh) | Al particle (mesh) |
|---|---|---|
| 18 | −150~+325 | −200~+325 |
| 19 | −150~+325 | −325 |
| 20 | −325 | −200~+325 |
| 21 | −100~+200 | −100~+200 |

Embodiments 22–29

Different Thermocouple Positions and Compressing Occasions

A titanium powder of −325 mesh and an aluminum powder of −325 mesh are mixed. The atomic ratio of Ti:Al is 1:1. The mixed powder is compressed under a molding pressure of 30 kg/cm$^2$ to form a reactant compact having a diameter of 10 mm and a height of 12 mm. The reactant compact is put into the mold. Different thermocouples shown in FIG. 1 are used in different embodiments respectively to measure the temperature of the reactant compact. A 50 Watt power is applied to the heating element. One end of the reactant compact is then heated and ignited. When the temperature of the reactant compact reaches the earlier, middle or later duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 7. The earlier duration 4A, the middle duration 4B, and the later duration 4C of the gradient temperature-distribution 4 shown in FIG. 4 can be taken as an example to illustrate how to separate the gradient temperature profile into the earlier duration, the middle duration, and the later duration.

TABLE 7

| embodiment | thermocouple | compressing occasion (earlier, middle, or later duration of the gradient temperature profile) |
|---|---|---|
| 22 | 132 | earlier duration |
| 23 | 132 | later duration |
| 24 | 131 | earlier duration |
| 25 | 131 | middle duration |
| 26 | 131 | later duration |
| 27 | 133 | earlier duration |
| 28 | 133 | middle duration |
| 29 | 133 | later duration |

Embodiments 30–31

Different Reactant Compact Shapes

A titanium powder of −325 mesh and an aluminum powder of −325 mesh are mixed. The atomic ratio of Ti:Al is 1:1. The mixed powder is compressed tinder a molding pressure of 30 kg/cm$^2$ to form a rectangular reactant compact. Different sized rectangular compacts as listed in Table 8 are formed in different embodiments respectively. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 8.

TABLE 8

| embodiment | reactant compact size length × width × height(mm) | thermocouple position |
|---|---|---|
| 30 | 10 × 10 × 10 | middle (longitudinal direction) |
| 31 | 15 × 12 × 10 | middle (longitudinal direction) |

Embodiments 32–40

Determining the Compression Occasion by the Reaction Time

A titanium powder of −325 mesh and an aluminum powder of −325 mesh are mixed. The atomic ratio of Ti:Al is 1:1. The mixed powder is compressed under a molding pressure of 30 kg/cm$^2$ to form a reactant compact having a diameter of 10 mm and a height of 12 mm. The reactant compact is put into the mold. The thermocouple 132 as shown in FIG. 1 is used to measure the temperature of the reactant compact. A stopwatch is used for recording the reaction time of the combustion synthesis reaction of the reactant compact. A 50 Watt power is applied to the heating element. One end of the reactant compact is then heated and ignited. The stopwatch begins to record the reaction time as soon as the end of the reactant compact begins to be heated by the heating element. At the time when the temperature of the reactant compact reaches the duration of the gradient temperature profile as shown in Table 9, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material. The parameters of these embodiments are listed in Table 9.

| embodiment | compressing occasion |
|---|---|
| 32 | earlier duration |
| 33 | middle duration |
| 34 | later duration |
| 35 | earlier duration |
| 36 | middle duration |
| 37 | later duration |
| 38 | earlier duration |
| 39 | middle duration |
| 40 | later duration |

Embodiment 41

Symmetrically Functionally Gradient Material

A −325 mesh titanium powder and a −325 mesh aluminum powder are mixed. The atomic ratio of Ti:Al is 1:1. The mixed powder is compressed under a molding pressure of 30 kg/cm$^2$ to form a reactant compact having a diameter of 10 mm and a height of 12 mm. The reactant compact is put into the mold. Referring to FIG. 9, two heating elements 92 and 93 are respectively mounted beside the axial ends 911 and 912 of the reactant compact 91. Each of the heating elements 92 and 93 is a coil having a diameter of 4.8 mm made by winding by a tungsten filament having a diameter of 0.6 mm. Two thermocouples pierce through the mold and contact the surface of the reactant compact at their measuring points respectively. The two measuring points are respectively 3 mm and 9 mm away from the axial top of the reactant compact. A 50 Watt power is applied to each of the heating elements simultaneously. The two ends of the reactant compact are then heated and ignited at the same time. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $TiAl_x$—Ti—Al functionally gradient composite material having a symmetrical structure.

Embodiments 42–45

Different Intermetallic Materials

Different metallic powders (such as Fe powder or Ni powder. etc.) instead of the titanium/aluminum powder are used in different embodiments. For example, a nickel powder of −325 mesh and a aluminum powder of −325 mesh are mixed. The atomic ratio of Ni:Al is 1:1. The mixed powder is compressed under a molding pressure of 30 kg/cm$^2$ to form a reactant compact having a diameter of 10 mm and a height of 12 mm. The reactant compact is put into the mold. The thermocouple 132 as shown in FIG. 1 is used to measure the temperature of the reactant compact. A 50 Watt power is applied to the heating element. One end of the reactant compact is then heated and ignited. When the temperature of the reactant compact reaches the middle duration of the gradient temperature profile, a mechanical pressure of 324 MPa is applied to the mold. Accordingly, the product is obtained. The product is analyzed by SEM, XRD, and micro-hardness measurement and is identified as a $NiAl_x$—Ni—Al functionally gradient composite material. The parameters of these embodiments are listed in Table 10.

TABLE 10

| embodiment | metallic powders used | product |
|---|---|---|
| 42 | Ni + Al | $NiAl_x$ + Ni + Al functionally gradient composite material |
| 43 | Fe + Al | $FeAl_x$ + Fe + Al functionally gradient composite material |
| 44 | Ti + Ni | $TiNi_x$ + Ti + Ni functionally gradient composite material |
| 45 | Ti + Fe | $TiFe_x$ + Ti + Fe functionally gradient composite material |

To sum up, in the present invention, the occasion of applying the pressure to the reactant compact is controlled and a functionally gradient composite material can be obtained. Furthermore, a gradient-composition-distributed or multi-layer reactant compact is no more needed in the present invention. Accordingly, a more efficient manufacturing process is obtained and the cost is reduced. Moreover, since different composition distributions of products can be obtained from the same reactant compacts by controlling the compressing occasion, there is no need to prepare different reactant compacts for different applications. It is seen that the present invention is more convenient, efficient, and economical than prior arts.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and the appended claims which are to be accorded with the broadest interpretation so as to encompass all such modifications and similar structures.

What is claimed is:

1. A method for manufacturing a dense and functionally gradient composite material, comprising steps of:

(a) preparing a reactant compact;

(b) igniting said reactant compact so that a combustion wave is propagating on said reactant compact; and (c) compressing said reactant compact while a temperature profile of said reactant compact is gradient to obtain said dense and functionally gradient composite material.

2. A method according to claim 1 wherein said reactant compact has a specific shape and said step (a) includes steps of:

(a1) evenly mixing a first metal powder and a second metal powder into a mixed powder; and (a2) compressing said mixed powder in a mold to form said reactant compact with said specific shape.

3. A method according to claim 2 wherein said first metal powder and said second metal powder are selected from a group consisting of a titanium powder and an aluminum powder, a titanium powder and an iron powder, a nickel powder and an aluminum powder, a titanium powder and a nickel powder, and an iron powder and an aluminum powder.

4. A method according to claim 3 wherein said composite material is one selected from $TiAl_x$—Ti—Al, $TiFe_x$—Ti—Fe, $NiAl_x$—Ni—Al, $FeAl_x$—Fe—Al and $TiNi_x$—Ti—Ni.

5. A method according to claim 2 wherein said first metal powder and said second metal powder are mixed in a molar ratio of about 1:0.9 to about 1:3 to form said mixed powder.

6. A method according to claim 2 wherein in said step (a2), said mixed powder is compressed at a pressure of about 20–80 $Kg/cm^2$ in said mold to form said reactant compact.

7. A method according to claim 1, further includes steps between said step (a) and said step (b):

(b01) putting said reactant compact into a mold filled with a fluidized medium; and (b02) putting said mold into a compressing device, wherein in said step (c) said reactant compact is compressed by said compressing device in a way of compressing said fluidized medium through said mold.

8. A method according to claim 7 wherein said fluidized medium is a refractory material with a resistance to a temperature above about 1000° C.

9. A method according to claim 7 wherein said fluidized medium is a ceramic powder.

10. A method according to claim 9 wherein said ceramic powder is one selected from a group consisting of a casting sand, an $Al_2O_3$ powder, a $ZrO_2$ powder and a SiC powder.

11. A method according to claim 7 wherein said compressing device is a hydraulic press.

12. A method according to claim 7 wherein said mold is an alloy steel mold.

13. A method according to claim 7 wherein said mold further includes a heating element for igniting said reactant compact; and a temperature measuring device for detecting the temperature of said reactant compact.

14. A method according to claim 13 wherein said heating element is one selected from a group consisting of a tungsten filament, a tungsten slice, a graphite slice, and a graphite tape.

15. A method according to claim 13 further comprising a step of mounting a kindling block between said heating element and said reactant compact to heat said reactant compact uniformly in said step (b).

16. A method according to claim 15 wherein said kindling block is made by compressing a powder of a kindling material in a mold to obtain said kindling block having a cross section identical to that of said reactant compact.

17. A method according to claim 15, wherein said powder of said kindling material is one selected from a group consisting of a mixing powder of titanium and carbon, a mixing powder of magnesium and $Fe_3O_4$, and a mixing powder of aluminum and $Fe_3O_4$.

18. A method according to claim 1 wherein said temperature profile of said reactant compact is detected by a temperature measuring device to obtain a measuring result to be shown on a time recorder.

19. A method according to claim 18 wherein said step (c) are executed when said measuring result shown on said time recorder is gradient.

20. A method according to claim 18 wherein said temperature measuring device includes a plurality of thermocouples distributed along the propagating direction of said combustion wave.

21. A method according to claim 20 wherein said plurality of thermocouples are pt/pt-10% Rh thermocouples.

22. A method according to claim 1, before said step (a) further comprising steps of:

(a01) preparing a blank-test reactant compact identical to said reactant compact in step (a);

(a02) igniting said blank-test reactant compact;

(a03) burning said blank-test reactant compact without compressing but recording the temperature profile of said reactant compact; and (a04) analyzing said temperature profile of said reactant compact to obtain a time duration, wherein in said step (c) said reactant compact is compressed according to said time duration.

23. A method according to claim 1 wherein in said step (b), said reactant compact is ignited on only one end of said reactant compact.

24. A method according to claim 1 wherein in said step (b), said reactant compact is ignited on two opposite ends of said reactant compact in order that a symmetrical temperature gradient of said reactant compact is obtained.

25. A method according to claim 1 wherein in said step (c), said reactant compact begins to be compressed on a specific time of the time duration when said temperature profile of said reactant compact is gradient.

26. A method according to claim 1 wherein in said step (c), said reactant compact is compressed tinder a pressure of about 100 to 500 MPa.

* * * * *